United States Patent [19]

Bechis Michele

[11] 4,205,397

[45] Jun. 3, 1980

[54] BATHING DRAWERS

[76] Inventor: Michele Bechis, Via Statale, 20, Merate, Italy

[21] Appl. No.: 927,017

[22] Filed: Jul. 24, 1978

[30] Foreign Application Priority Data

Apr. 17, 1978 [IT] Italy ..... 21529/78[U]

[51] Int. Cl.[2] ..... A41D 5/00

[52] U.S. Cl. ..... 2/67; 2/406; 2/238

[58] Field of Search ..... 2/73, 78 B, 78 C, 67, 2/227, 238, 404, 400, 401, 402, 406, 407; 156/244.23; 24/73, 67 A, 67 R

[56] References Cited

U.S. PATENT DOCUMENTS

| | | | |
|---|---|---|---|
| 2,446,326 | 8/1948 | Guithues | 2/238 |
| 2,511,080 | 6/1950 | Rosenbuum | 2/275 |
| 2,522,510 | 12/1950 | Fridolph | 2/407 |
| 3,294,617 | 12/1966 | Way | 2/275 |
| 3,436,762 | 4/1969 | Cahan | 2/67 |
| 3,541,063 | 6/1969 | Dworl | 2/406 |
| 3,613,119 | 10/1971 | Sarmiento | 2/407 |
| 3,783,072 | 1/1974 | Korpman | 156/244.23 |
| 3,932,896 | 1/1976 | Dottinger | 2/67 |

*Primary Examiner*—Werner H. Schroeder
*Assistant Examiner*—Doris L. Troutman
*Attorney, Agent, or Firm*—Bucknam and Archer

[57] ABSTRACT

Bathing trunks made of an elastic and preferably plasticized cloth, formed by a single piece shaped in such a way as to reproduce, in succession, one rear half, the front portion and the remaining rear half, the longitudinal edges of said rear halves being connected to one another by means of a cross-stich seam, are described. The rear and front flaps forming the lower middle portion of the trunks are seamed together by interposing a strip provided with a plurality of transversely extending holes.

1 Claim, 5 Drawing Figures

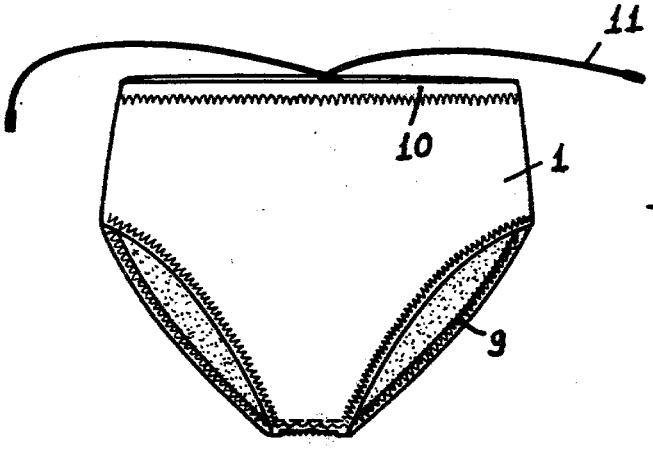
Fig. 1
Fig. 2
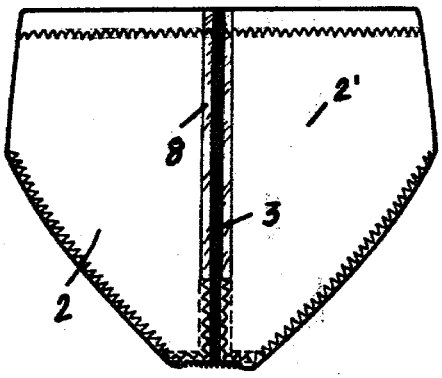
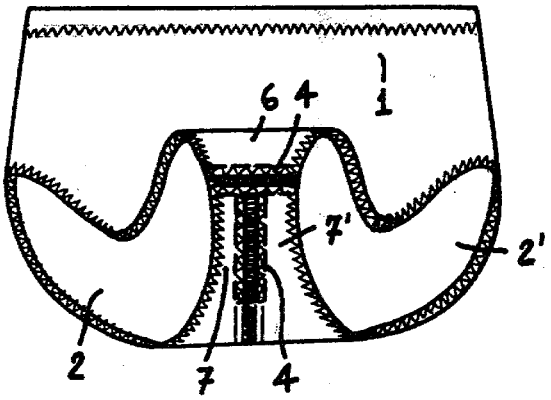
Fig. 3

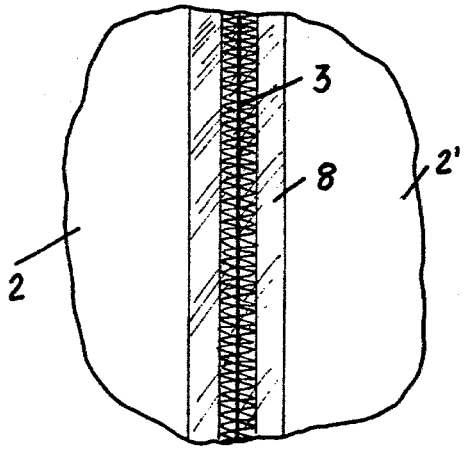
Fig. 4
Fig. 5
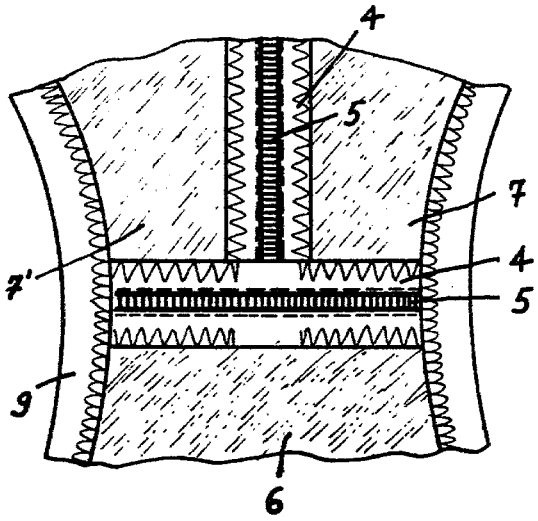

BATHING DRAWERS

The present invention relates to an improved bathing drawers. More particularly the present invention relates to a bathing drawers provided with a single seam.

As it is known, the bathing-costumes, especially if used for sports, have to be of great strength.

The weak points which may be present in the at present commercially available bathing-costumes, are substantially caused by the two side seams joining together the two front and rear portions of said bathing-costumes.

It is an object of the present invention to eliminate the aforesaid weak points thereby providing high strength bathing drawers or costumes.

According to the present invention, this object is achieved by providing the bathing costume as a single cloth piece longitudinally shaped in such a way as to reproduce in succession a half of the rear portion, the front portion overally and the remaining portion of the rear portion and by joining together the free ends by means of a cross-stitch seam.

Said seam, at the lower portion of the bathing costume, is carried out by interposing a strip provided with a plurality of holes as formed axially transversally with respect to said strip.

The two flaps forming the bathing costume middle lower portion are also connected by means of a strip provided with a plurality of holes.

By this approach, at the lower portion of the bathing costume a plurality of holes are formed facilitating the discharging of water from the inside of the bathing costume itself.

The outer face of the cross-stitch seam connecting the contacting edges of the two rear halves of the bathing costume is preferably protected by adhesive tape, preferably of a thermofusible type, thereby preventing said stitches from being accidentally removed.

In order to better understand the functional and constructional characteristics of the present invention, the instant improved bathing drawers or costume will be thereinafter described with reference to the figures of the accompanying drawings illustrating an exemplificative and not limitative preferred embodiment of the bathing drawers or costume, where:

FIG. 1 is a front view of the instant bathing costume;

FIG. 2 is a rear view of the bathing costume shown in FIG. 1;

FIG. 3 is a detail view of the lower portion of the instant bathing costume as provided with a plurality of water discharging holes;

FIG. 4 is a view illustrating the outer arrangement of the cross-stitch seam connecting the contacting edges of the two rear portions of the bathing costume; and FIG. 5 is a view taken from the inside of that same bathing costume, at the lower and rear portions thereof as provided with water discharging holes.

Referring particularly to the figures, the instant improved bathing drawers or costume is formed by an elastic and preferably plasticized cloth. Said cloth is cut in such a way as to reproduce the front portion (1) and the two rear halves (2) and (2') of the bathing costume. The longitudinal edges of said two halves (2) and (2') are connected, starting from the top and nearly for the overall extension thereof, by means of a cross-stitch seam (3).

The lower portion of said edges is seamed by interposing a strip (4) provided with a plurality of transversely extending holes (5) formed along the axis of said strip.

By means of that same type of strip (4) it is carried out the connection of the front and rear flaps, indicated respectively by (6) and (7) and (7'), forming the lower middle portion of the bathing costume.

Furthermore on the outside of the seam (3) joining together the flanked edges of the two rear halves (2) and (2') a band of adhesive tape (8) is applied, preferably of the thermofusible type, effective to protect the seam stitches against casual tears. As shown in FIGS. 2 and 4, a space is left between the two bands of adhesive tape which are applied adjacent this seam.

The thus obtained bathing costume is provided, in a known manner, with hems (9) and an upturned edge (10) effective to hold a cord or small strip (11) for fixing at the waist.

From the above description and the examination of the several figures of the accompanying drawings, the functionality and use practicity characterizing the bathing costume according to the invention are self-evident.

I claim:

1. An improved bathing trunks and the like made of an elastic cloth, which consists essentially of a single piece of elastic cloth which is so shaped as to reproduce in succession the first rear half, the front portion and the second rear half of said bathing trunks, the longitudinal free edges of said first rear half and said second rear half being respectively seamed to one another by a first cross stitch seam, the rear and front flaps forming the lower middle portion of the bathing trunks being respectively seamed together by a second cross stitch seam, a strip provided with a plurality of transversely extending apertures being formed along the axis thereof being interposed on said first cross stitch seam and second cross stitch seam and bands of adhesive tape being applied adjacent the seam which joins the longitudinal edges of the first rear half and second rear half, said bands of adhesive tape leaving a space therebetween.

* * * * *